US008174206B2

(12) United States Patent
Hsueh et al.

(10) Patent No.: US 8,174,206 B2
(45) Date of Patent: May 8, 2012

(54) ENCODING DEVICE FOR LIGHT-EMITTING-DIODE LAMP, LAMP, AND CONTROLLED LIGHTING SYSTEM

(75) Inventors: Hsiang-Chun Hsueh, Taipei (TW); Horng-Ming Tai, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 973 days.

(21) Appl. No.: 12/216,563

(22) Filed: Jul. 8, 2008

(65) Prior Publication Data

US 2009/0261750 A1 Oct. 22, 2009

(30) Foreign Application Priority Data

Apr. 16, 2008 (CN) ..... 2008 1 0090481

(51) Int. Cl.
*H05B 41/36* (2006.01)

(52) U.S. Cl. ..... 315/291; 315/294

(58) Field of Classification Search ..... 315/291, 315/294, 297, 307, 312
See application file for complete search history.

(56) References Cited

U.S. PATENT DOCUMENTS

| | | | | |
|---|---|---|---|---|
| 4,992,774 | A * | 2/1991 | McCullough | 345/204 |
| 6,069,457 | A | 5/2000 | Bogdan | |
| 6,225,759 | B1 * | 5/2001 | Bogdan et al. | 315/291 |
| 6,292,901 | B1 | 9/2001 | Lys et al. | |
| 7,127,631 | B2 * | 10/2006 | D'Angelo et al. | 713/502 |
| 2003/0222587 | A1 * | 12/2003 | Dowling et al. | 315/149 |
| 2008/0183081 | A1 * | 7/2008 | Lys et al. | 600/477 |

* cited by examiner

*Primary Examiner* — Jacob Y Choi
*Assistant Examiner* — Ephrem Alemu
(74) *Attorney, Agent, or Firm* — Rosenberg, Klein & Lee

(57) ABSTRACT

A controlled lighting system includes an encoding device and a lamp. The encoding device includes a rectifier for rectifying an AC voltage input to result in a rectified signal, and an encoder for generating an encoded signal from the rectified signal and display data. The encoded signal has consecutive signal regions with a waveform of a positive half-cycle of an AC sinusoidal wave or a low potential. The lamp includes a LED unit and a decoding device. The decoding device includes a direct current converter for extracting a direct current voltage from the encoded signal, a detecting circuit for extracting a wave signal from the encoded signal, a processor for generating decoded data related to a light-emitting operation according to the wave signal, and a driver for driving the LED unit according to the direct current voltage from the direct current converter and the decoded data from the processor.

20 Claims, 11 Drawing Sheets

ENCODING DEVICE FOR LIGHT-EMITTING-DIODE LAMP, LAMP, AND CONTROLLED LIGHTING SYSTEM

CROSS-REFERENCE TO RELATED APPLICATION

This application claims priority of Chinese application no. 200810090481.4, filed on Apr. 16, 2008.

BACKGROUND OF THE INVENTION

1. Field of the Invention

The invention relates to an encoding device, a lamp, and a controlled lighting system, more particularly to an encoding device for a light-emitting-diode (LED) lamp, a lamp, and a controlled lighting system.

2. Description of the Related Art

Referring to FIG. 1, in a conventional method for controlling illumination of LED lamps 61, two twisted-pair lines are connected to two input ports of a LED lamp 61 for supplying power and control signals thereto. However, when a lighting system includes a large number of the LED lamps 61, a network system 62 formed by the twisted-pair lines becomes more complex, thereby making installation more difficult.

Referring to FIG. 2, U.S. Pat. No. 6,292,901 discloses a conventional control system that adopts a power/data protocol. The control system combines power and control signals such that each LED lamp 8 only requires one input port. As a result, a single transmission line is sufficient to control a light-emitting operation of a LED 82, thereby effectively reducing wiring complexity.

The conventional control system is adapted to control color emitted by a LED 82 in a lamp 8, and is coupled electrically to an adapter 63 that converts an alternating current (AC) power input into a direct current (DC) power output. The conventional control system includes an encoding device 71, and a decoding device 81 built into the lamp 8. Referring to FIGS. 3 and 5, the encoding device 71 includes a RS-485 receiver 711, a voltage regulator 712, and a pulse width modulation driver 713. The RS-485 receiver 711 converts a differential pair that contains a control signal into a digital signal. The voltage regulator 712 regulates the DC power output and provides regulated DC power to the pulse width modulation driver 713 for operation of the latter. The pulse width modulation driver 713 combines the digital signal and the regulated DC power, and outputs an AC square wave signal.

Referring to FIGS. 4 and 5, the decoding device 81 includes a voltage divider 811, receives the AC square wave signal through the transmission line, and converts the AC square wave signal into a voltage-divided signal in a digital format suitable for processing by a processor that enables the LED 82 to emit a specified color.

Referring to FIG. 6, U.S. Pat. No. 6,069,457 discloses a conventional control system that controls brightness of a gas discharge light bulb 94 in a lamp through a single transmission line, and that is coupled to an AC power source 93. The conventional control system includes a dimmer switch 91, and a decoder 92 built into the lamp. The dimmer switch 91 includes a pair of switches (SW1), (SW2) which are controlled by a user for causing the dimmer switch 91 to provide an output signal from an AC power signal of the AC power source 93. FIG. 7 shows four possible waveforms of the output signal, which correspond respectively to maintain brightness of the gas discharge light bulb 94, increase brightness of the gas discharge light bulb 94, reduce brightness of the gas discharge light bulb 94, and turn-off the gas discharge light bulb 94.

The decoder 92 receives the output signal through the transmission line, and controls brightness of the gas discharge light bulb 94 according to the waveform of the output signal. The decoder 92 is not configured to control the color of the light emitted by the gas discharge light bulb 94.

SUMMARY OF THE INVENTION

The object of the present invention is to provide an encoding device for a light-emitting-diode lamp, a lamp, and a controlled lighting system, which simplify the configuration of the lamp, reduce the required amount of wires, and shorten the time for installing a lighting network.

According to one aspect of the present invention, there is provided an encoding device for a light-emitting-diode (LED) lamp. The encoding device is adapted to receive an alternating current (AC) voltage input and display data related to a light-emitting operation, and comprises a rectifier and an encoder.

The rectifier rectifies the AC voltage input to result in a rectified signal.

The encoder generates an encoded signal from the rectified signal and the display data. The encoded signal has an amplitude corresponding to a magnitude of the rectified signal, and a waveform corresponding to the display data. The encoded signal has a plurality of consecutive signal regions of equal time durations. Each of the signal regions has one of first and second states. The waveform of the signal region having the first state is a positive half-cycle of an AC sinusoidal wave. The waveform of the signal region having the second state is a low potential waveform.

According to another aspect of the present invention, there is provided a lamp adapted For receiving an encoded signal that includes a power component and a signal component related to a light-emitting operation. The lamp comprises a light-emitting-diode (LED) unit and a decoding device. The decoding device includes a direct current converter for extracting a direct current voltage from the encoded signal, a detecting circuit for extracting a wave signal in digital form from the encoded signal, a processor for generating decoded data related to a light-emitting operation of the LED unit in accordance with the wave signal extracted by the detecting circuit, and a driver for driving the LED unit according to the direct current voltage from the direct current converter and the decoded data from the processor.

According to yet another aspect of the present invention, there is provided a controlled lighting system adapted to receive an alternating current (AC) voltage input and display data related to a light-emitting operation. The controlled lighting system comprises an encoding device and a lamp.

The encoding device includes a rectifier and an encoder. The rectifier rectifies the AC voltage input to result in a rectified signal. The encoder generates an encoded signal from the rectified signal and the display data. The encoded signal has an amplitude corresponding to a magnitude of the rectified signal, and a waveform corresponding to the display data. The encoded signal has a plurality of consecutive signal regions of equal time durations. Each of the signal regions has one of first and second states. The waveform of the signal region having the first state is a positive half-cycle of an AC sinusoidal wave. The waveform of the signal region having the second state is a low potential waveform.

The lamp includes a light-emitting-diode (LED) unit and a decoding device. The decoding device includes a direct current converter for extracting a direct current voltage from the encoded signal, a detecting circuit for extracting a wave signal in digital form from the encoded signal, a processor for generating decoded data related to a light-emitting operation of the LED unit in accordance with the wave signal extracted by the detecting circuit, and a driver for driving the LED unit according to the direct current voltage from the direct current converter and the decoded data from the processor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
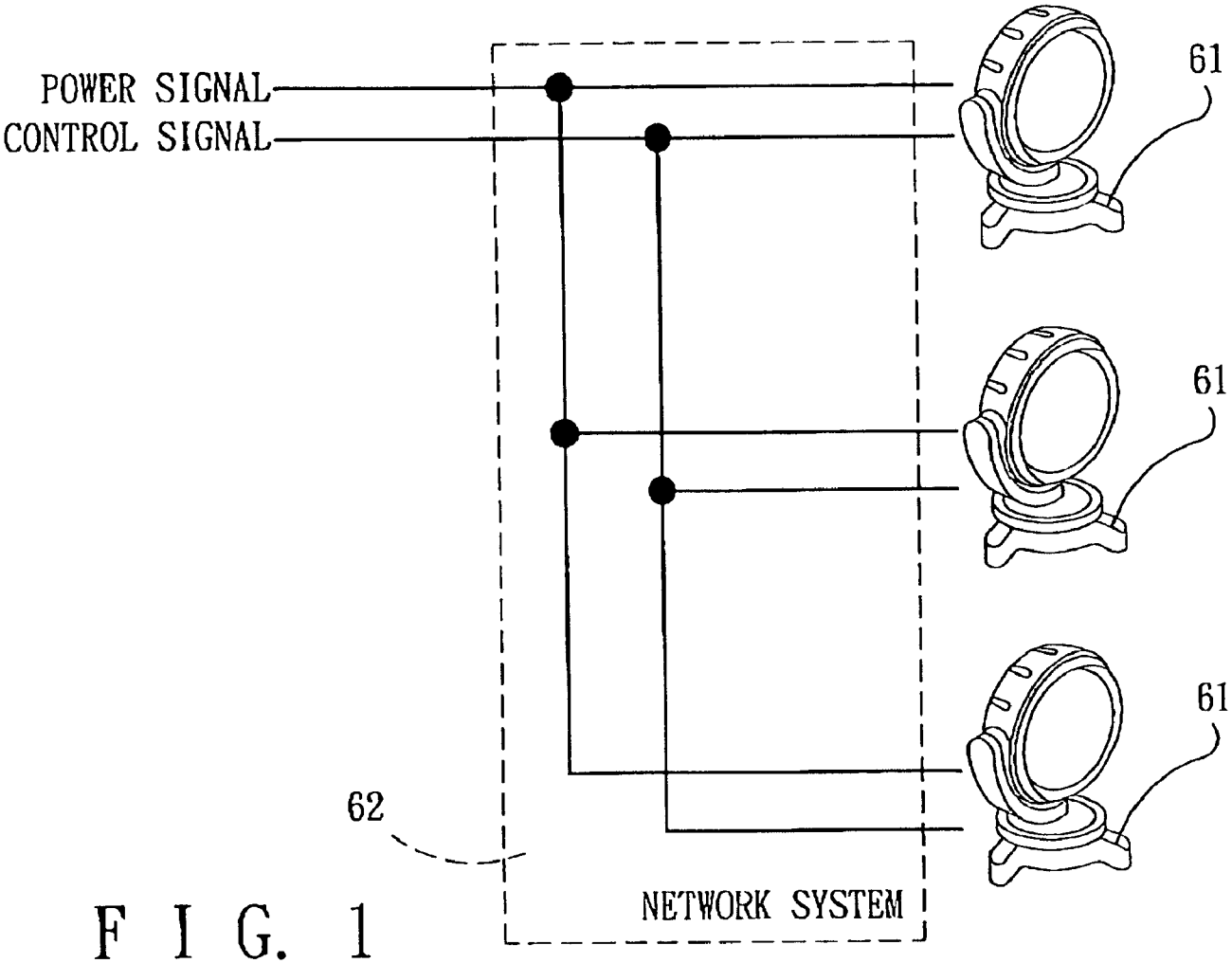
FIG. 1 PRIOR ART
FIG. 1 is a schematic diagram to illustrate a conventional method for illumination control in which two twisted-pair lines are respectively used to supply power and control signals to a LED lamp.
Figure 2:
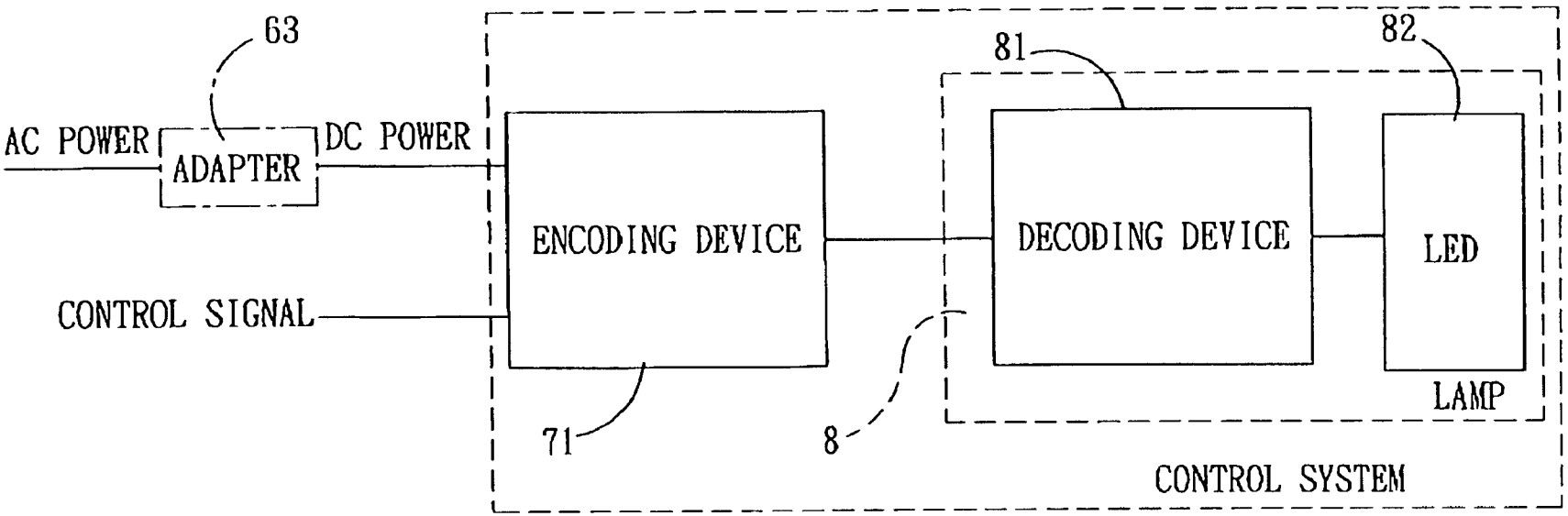
FIG. 2 PRIOR ART
FIG. 2 is a block diagram of a conventional control system that adopts a power/data protocol to control LED illumination.
Figure 3:
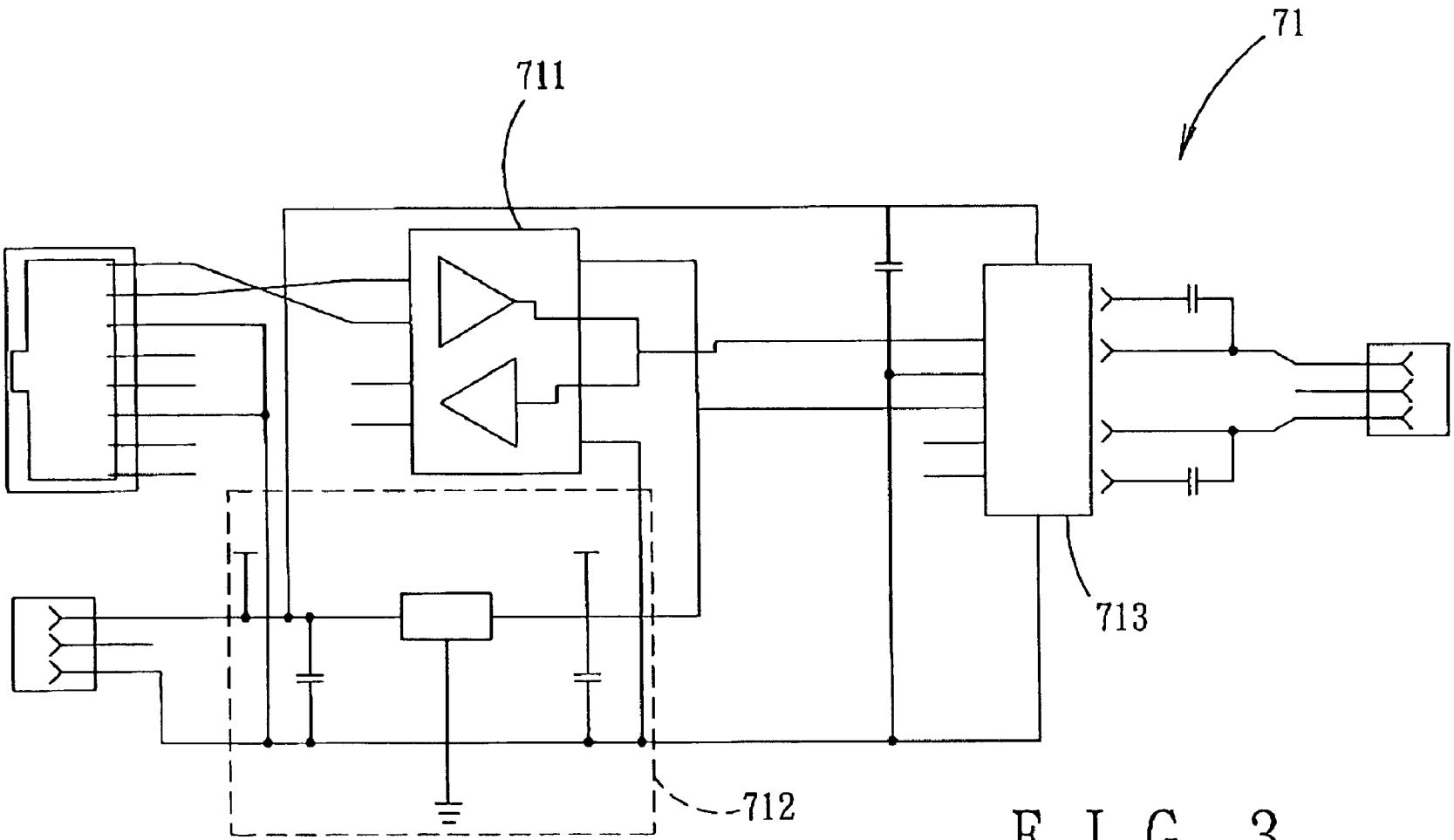
FIG. 3 PRIOR ART
FIG. 3 is a block diagram of an encoding device of the conventional control system of FIG. 2.
Figure 4:
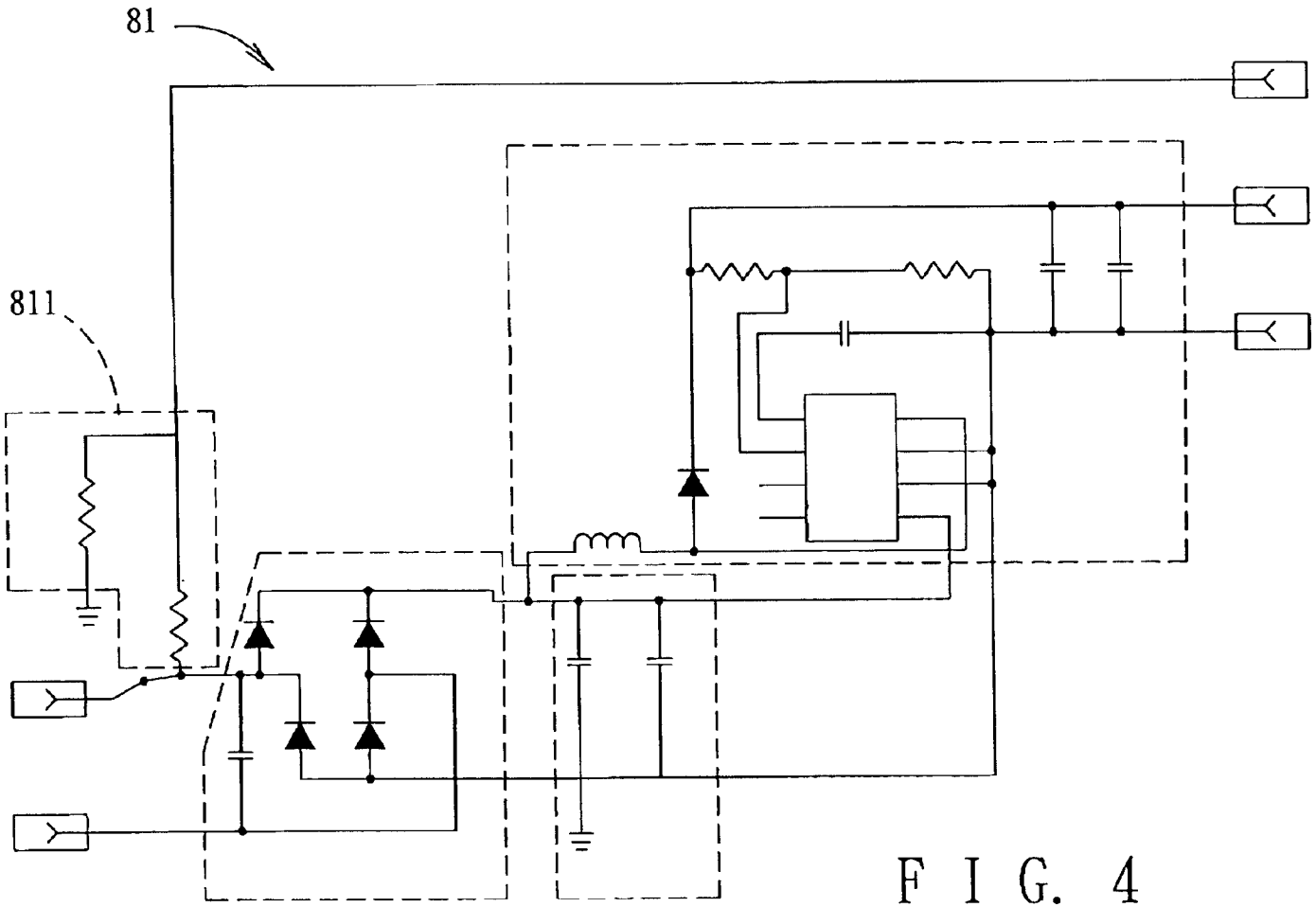
FIG. 4 PRIOR ART
FIG. 4 is a block diagram of a decoding device of the conventional control system of FIG. 2.
Figure 5:
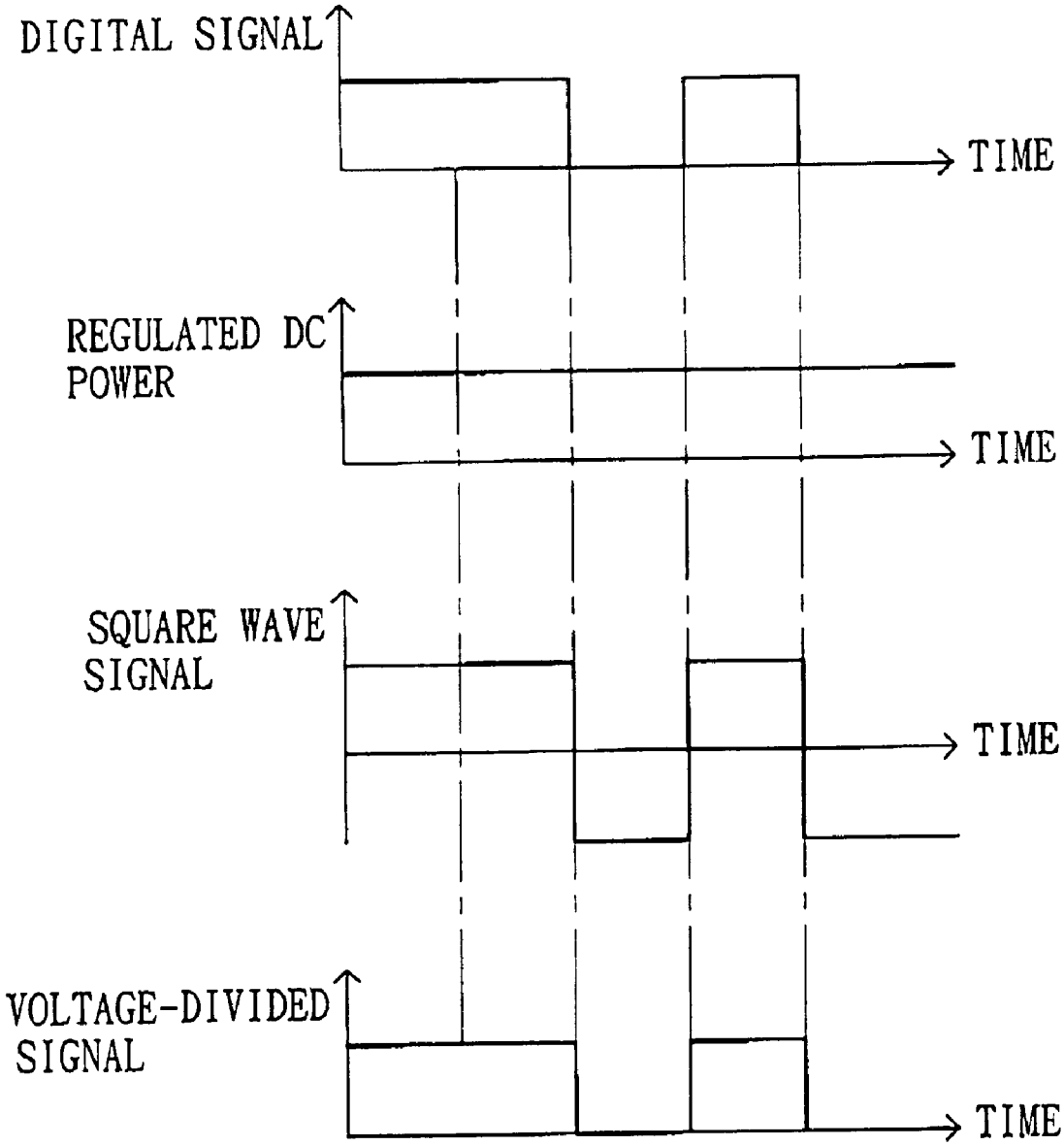
F I G. 5 PRIOR ART
FIG. 5 illustrates timing diagrams of various signals generated in the conventional control system of FIG. 2.
Figure 6:
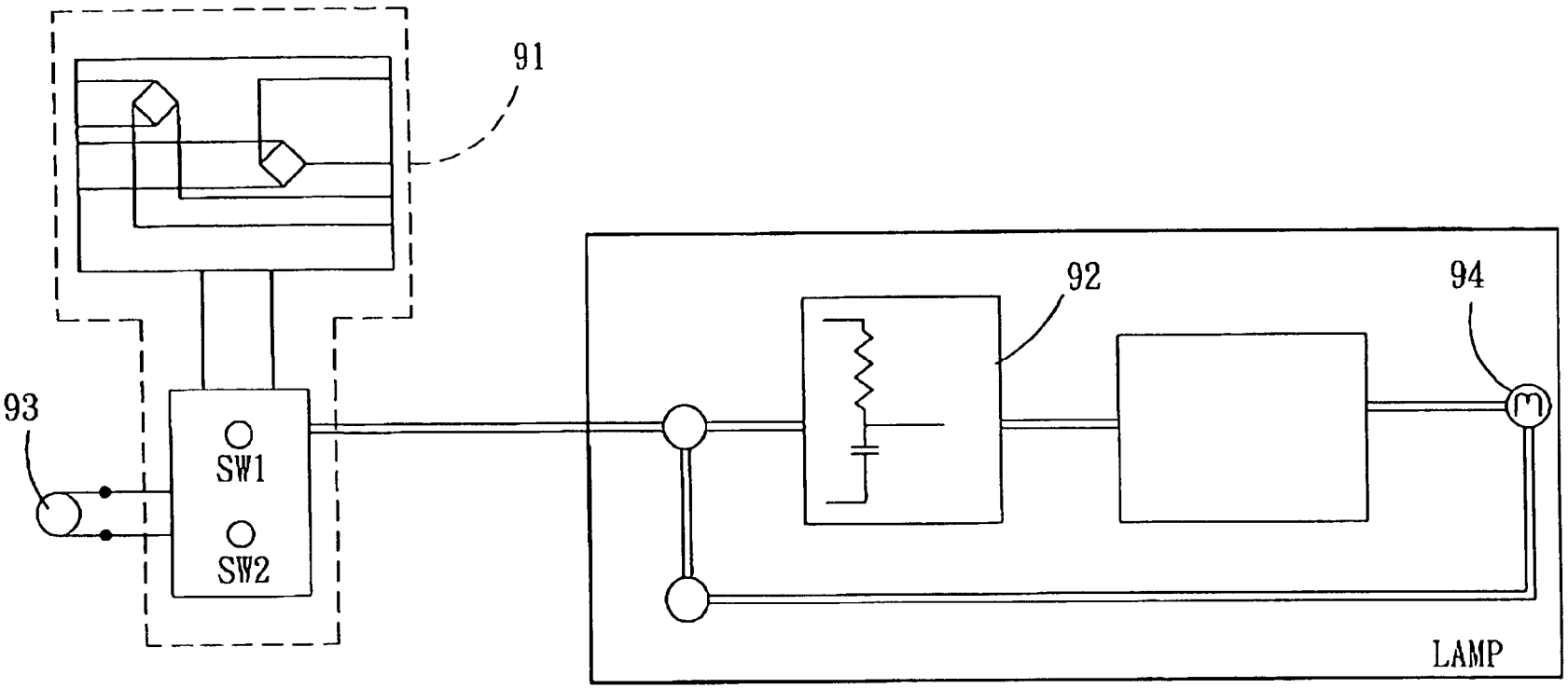
FIG. 6 PRIOR ART
FIG. 6 is a block diagram of another conventional control system.
Figure 7:
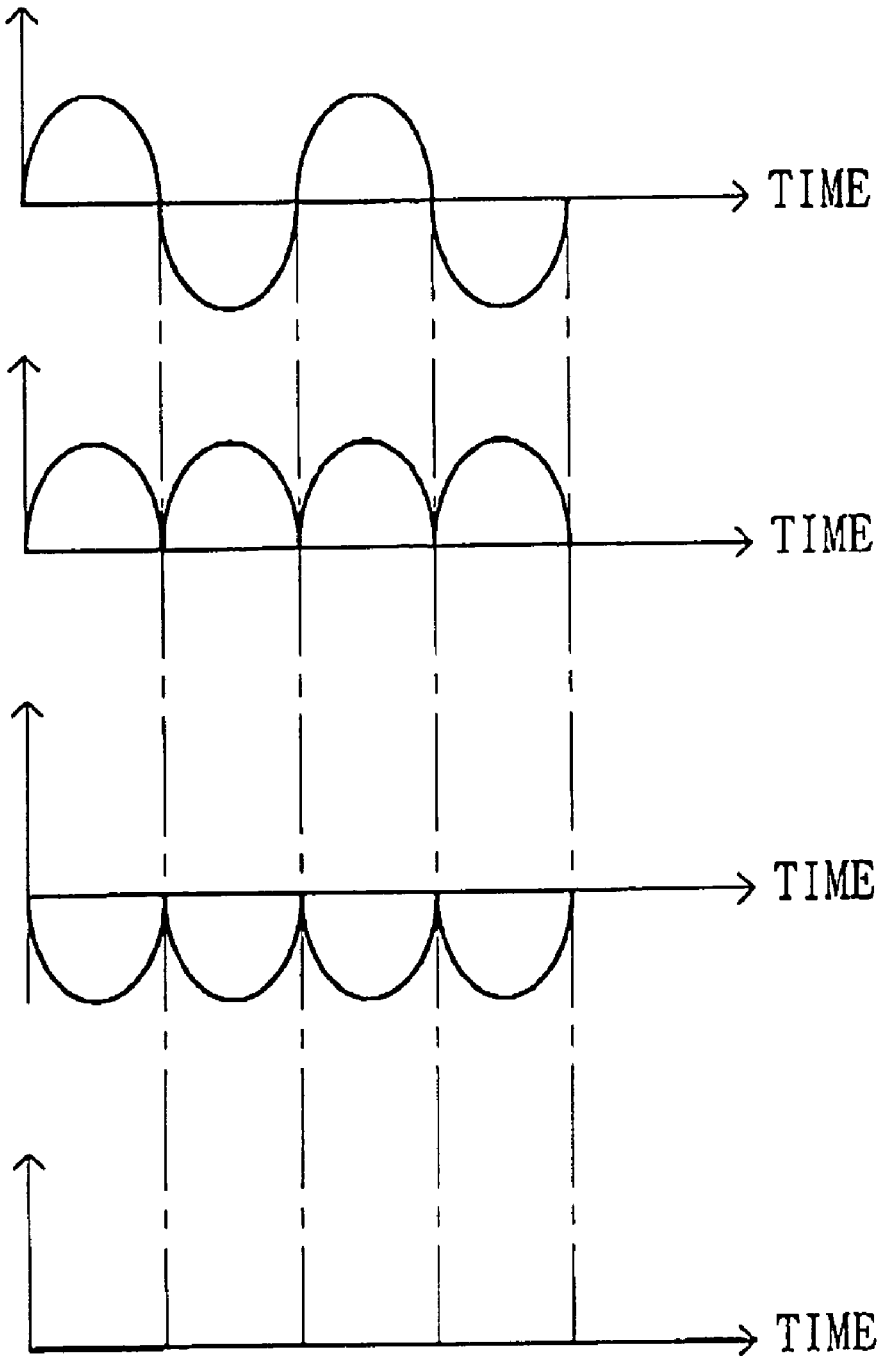
F I G. 7 PRIOR ART
FIG. 7 illustrates possible waveforms of an output signal of a dimmer switch in the conventional control system of FIG. 6.
Figure 8:
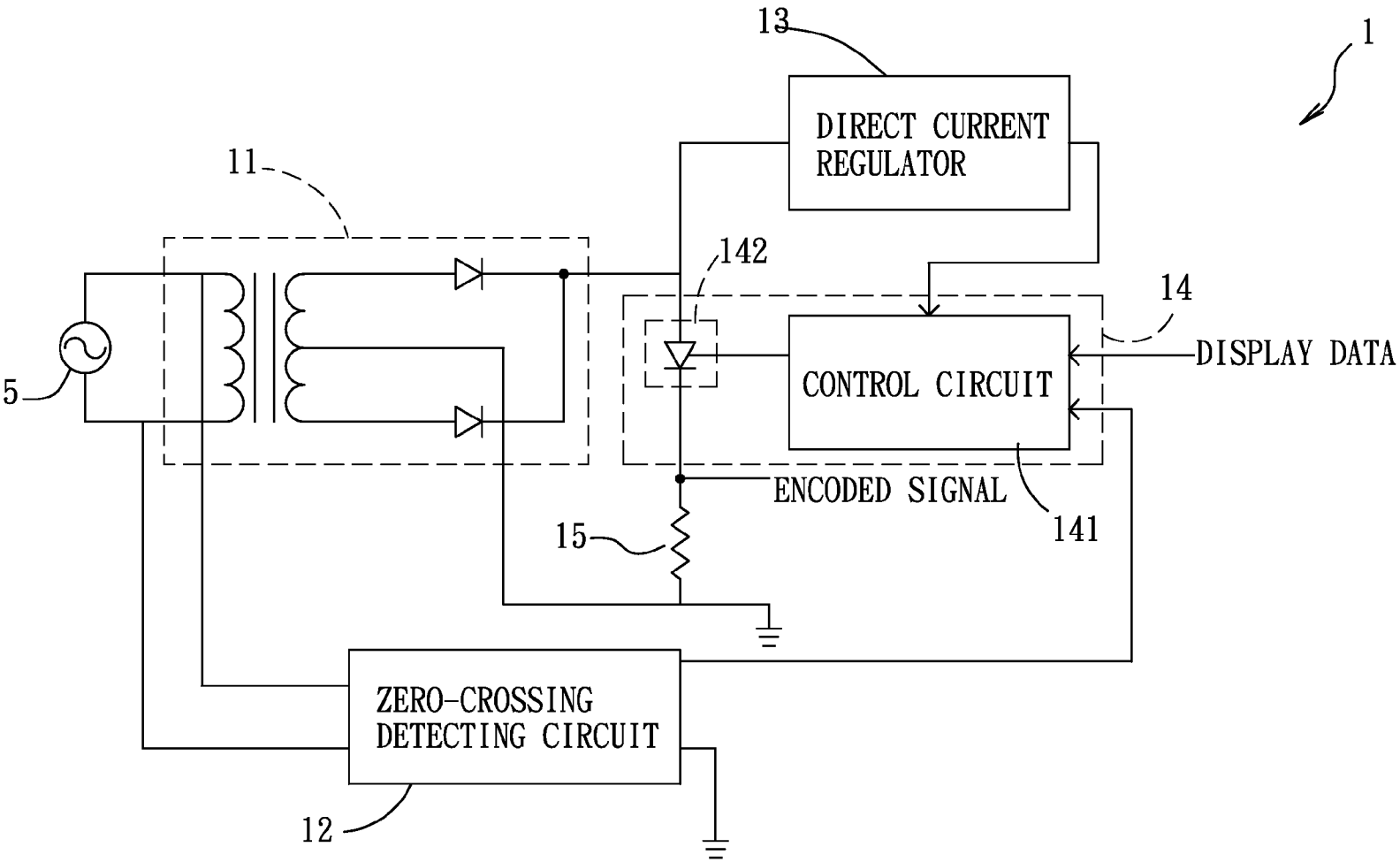
FIG. 8 is a block diagram of the preferred embodiment of an encoding device of a controlled lighting system according to the present invention.
Figure 9:
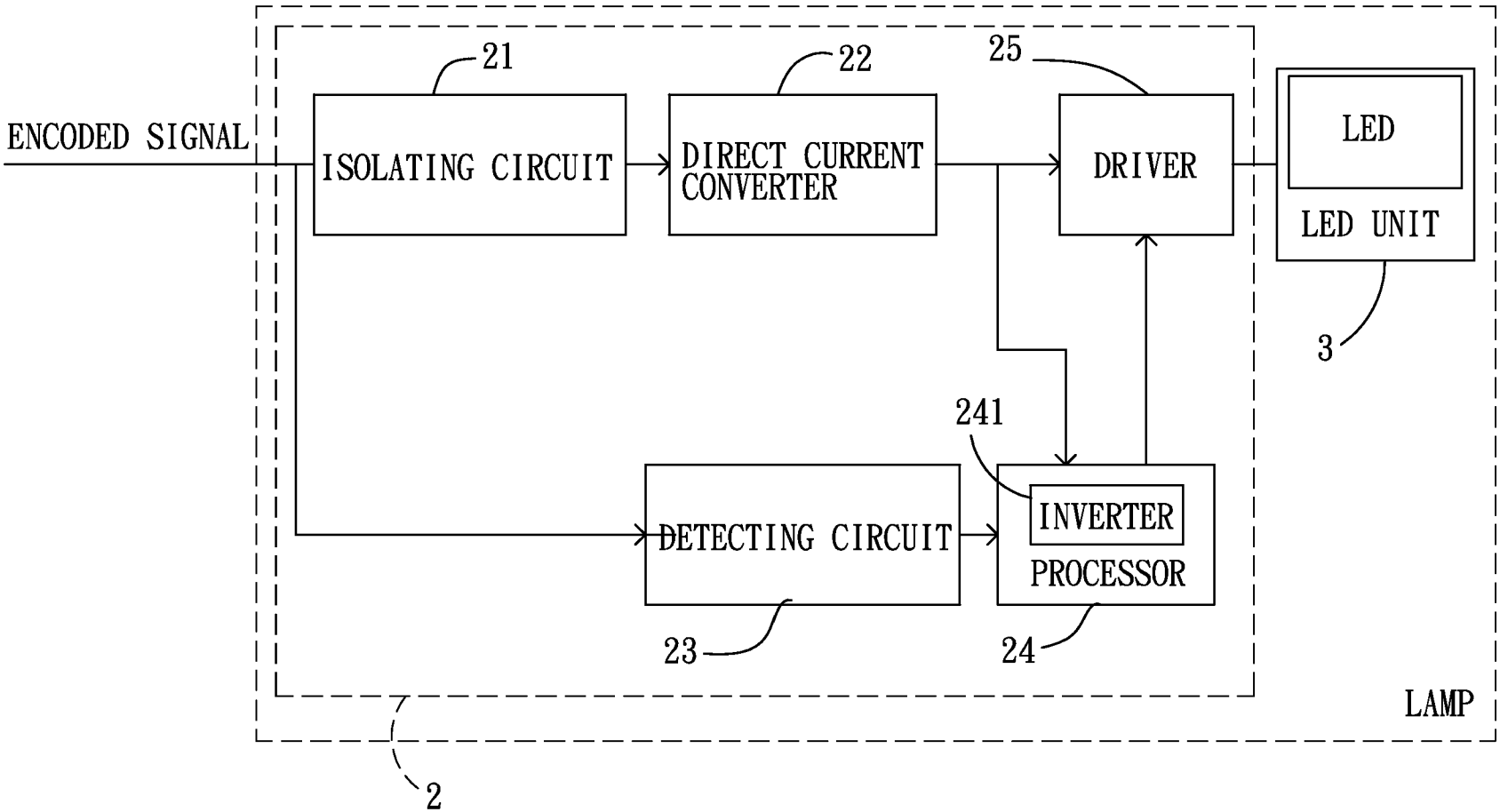
FIG. 9 is a block diagram of the preferred embodiment of a lamp according to the present invention.

Referring to FIGS. 8 and 9, the preferred embodiment of a controlled lighting system according to the present invention is adapted to receive an alternating current (AC) voltage input 5 and display data related to a light-emitting operation. The controlled lighting system comprises an encoding device 1 and a lamp. The lamp includes a light-emitting-diode (LED) unit 3 and a decoding device 2. The LED unit 3 includes at least one LED, and the amplitude of the AC voltage input 5 is chosen to correspond to the number of the LEDs in the LED unit 3. While controlled lighting is employed for control of color to be emitted by the LED unit 3 in this embodiment, controlled lighting may be employed for control of light-emitting intensity of the LED unit 3 in other embodiments of the invention.

Figures 10A, 10B, 10C, 10D, 10E, 10F, 10G, 10H, 10I:
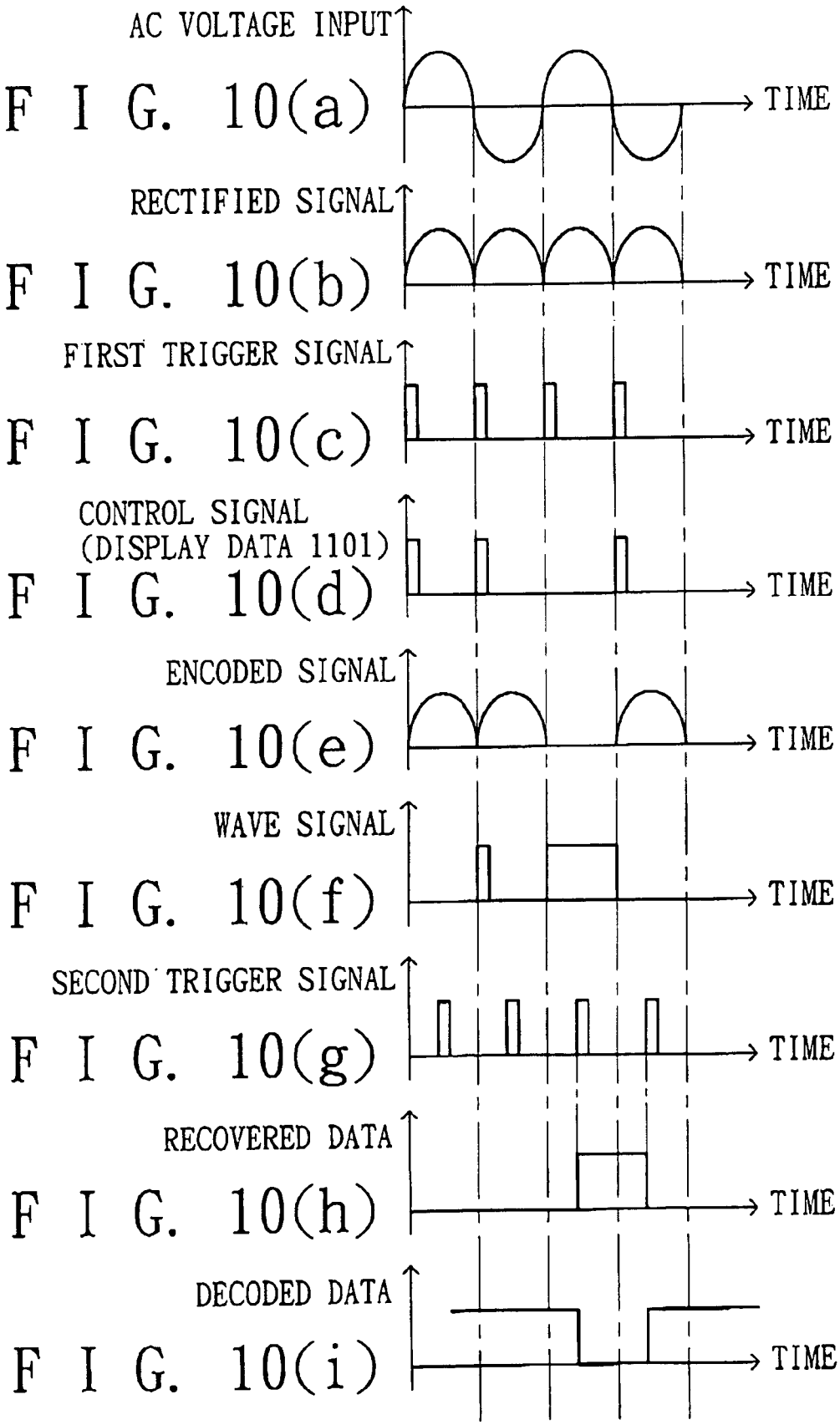
FIGS. 10(*a*) to 10(*i*) are timing diagram of various signals in the controlled lighting system of the preferred embodiment.

The encoding device 1 generates an encoded signal (see FIG. 10(*e*)) with reference to the display data. The display data includes a plurality of bits. Every N (N>1) bits of the display data indicates a desired color of light to be emitted by the LED unit 3, or no command is transmitted. For instance, "1100" indicates that the color of light emitted by the LED unit 3 is to be changed to yellow, "1101" indicates that the color of light emitted by the LED unit 3 is to be changed to green, and "1111" indicates that the color of light being emitted is to be maintained.

The encoding device 1 includes a rectifier 11, a zero-crossing detecting circuit 12, a direct current regulator 13, an encoder 14, and a resistor 15.

In this embodiment, the rectifier 11 is a full wave rectifier, receives the AC voltage input 5 (see FIG. 10(*a*)), and rectifies the AC voltage input 5 to result in a rectified signal (see FIG. 10(*b*)).

The rectified signal from the rectifier 11 has a waveform that includes a plurality of consecutive regions of equal time durations. The waveform in each of the regions of the rectified signal is a positive half-cycle of the AC sinusoidal wave. The amplitude of the rectified signal is determined by the AC voltage input 5. In particular, the amplitude of the rectified signal increases with an increase in the amplitude of the AC voltage input 5.

The zero-crossing detecting circuit 12 detects zero voltage points in the AC voltage input 5 to generate a first trigger signal (see FIG. 10(*c*)). When the AC voltage input 5 has zero amplitude, the zero-crossing detecting circuit 12 causes the first trigger signal to have a high potential, and when the AC voltage input 5 has non-zero amplitude, the zero-crossing detecting circuit 12 causes the first trigger signal to have a low potential. Since the AC voltage input 5 is a sinusoidal wave, the first trigger signal has a plurality of pulses corresponding to the zero voltage points (i.e., each pulse corresponds to a half-cycle of the AC voltage input 5).

The direct current regulator 13 regulates the rectified signal to result in a direct current voltage that is provided to the encoder 14.

The encoder 14 includes a control circuit 141 and aswitch 142. The control circuit 141 receives the direct current voltage from the direct current regulator 13, and generates a control signal (see FIG. 10(*d*)) according to the display data and the first trigger signal. The switch 142 is controlled by the control signal and selectively outputs the regions of the waveform of the rectified signal to result in the encoded signal (see FIG. 10(*e*)), which is a voltage across the resistor 15.

The amplitude of the encoded signal corresponds to a magnitude of the rectified signal. The waveform of the encoded signal corresponds to the display data. The waveform of the encoded signal has a plurality of consecutive signal regions of equal time durations. Each of the signal regions has one of first and second states. The waveform of the signal region having the first state is a positive half-cycle of an AC sinusoidal wave. The waveform of the signal region having the second state is a low potential waveform.

When the display data has a value of 1, the waveform of a corresponding one of the signal regions of the encoded signal has the first state, and an amplitude of the corresponding signal region having the first state increases with an increase in the amplitude of the rectified signal. On the other hand, when the display data has a value of 0, the waveform of a corresponding one of the signal regions of the encoded signal has the second state.

In one implementation of the encoder 14, each time the encoder 14 receives one of the pulses of the first trigger signal, the encoder 14 processes a corresponding bit of the display data. If the processed bit of the display data is 1, the control circuit 141 selects the first trigger signal for output as the control signal. On the other hand, if the processed bit of the display data is 0, the control circuit 141 selects the low potential waveform for output as the control signal. In this embodiment, the switch 142 is a silicon-controlled rectifier. When the switch 142 is triggered by the control signal, the rectified signal is outputted as the encoded signal until the rectified signal has zero amplitude or until the switch 142 is triggered once again by the control signal.

Figures 11A, 11B, 11C, 11D, 11E:
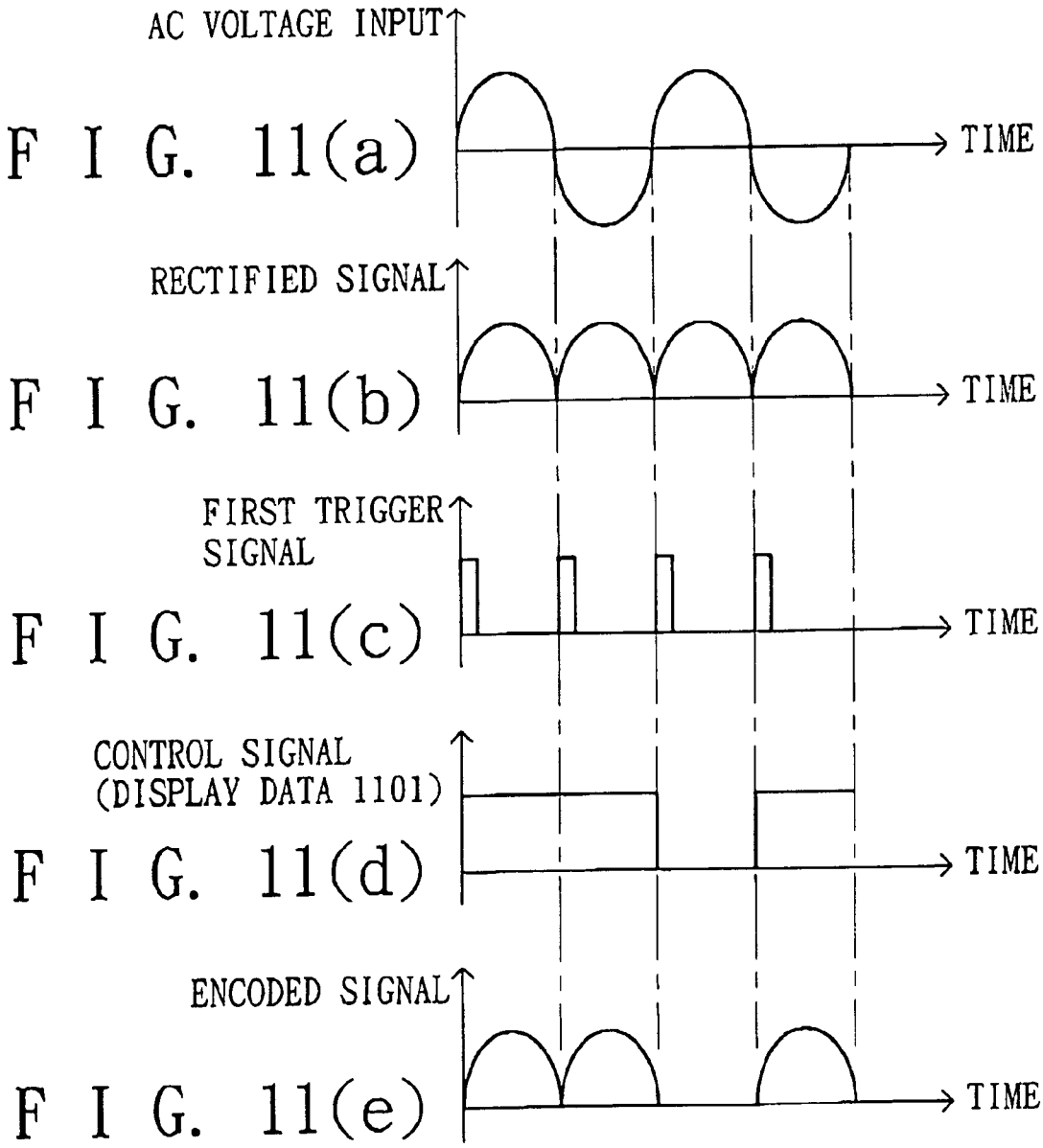
FIGS. 11(*a*) to 11(*e*) are timing diagrams of various signals in another controlled lighting system of this invention that incorporates a modified encoding device.

Referring to FIGS. 11(*a*) to 11(*e*), in another implementation of the encoder 14, each time the encoder 14 receives one of the pulses of the first trigger signal, the encoder 14 processes a corresponding bit of the display data. If the processed bit of the display data is 1, the control circuit 141 outputs a high potential waveform within a time period spanning two corresponding adjacent ones of the pulses of the first trigger signal as the control signal. On the other hand, if the processed bit of the display data is 0, the control circuit 141 outputs a low potential waveform within a time period spanning two corresponding adjacent ones of the pulses of the first trigger signal as the control signal. The switch 142 in this implementation is an enabler. When the control signal has the high potential waveform, the rectified signal is outputted as the encoded signal. When the control signal has the low potential waveform, the encoded signal has the low potential waveform.

Since the amplitude of the encoded signal corresponds to the magnitude of the rectified signal, which in turn is related to the amplitude of the AC voltage input 5, and since the waveform of the encoded signal corresponds to the display data, the encoded signal simultaneously presents a power component (corresponding to the AC voltage input 5) and a signal component related to a light-emitting operation (corresponding to the display data). Therefore, only one transmission line is required by the encoding device 1 to connect with an input port of a lamp to achieve the object of illumination control, thereby overcoming the drawbacks associated with the use of two twisted-pair lines to transmit power and control signals, respectively.

Referring to FIG. 9, the decoding device 2 is used to extract a direct current voltage and to generate decoded data (see FIG. 10(*i*)) from the encoded signal (see FIG. 10 (*e*)), and includes an isolating circuit 21, a direct current converter 22, a detecting circuit 23, a processor 24, and a driver 25.

The isolating circuit 21 isolates noise from the encoded signal prior to receipt of the encoded signal by the direct current converter 22.

The direct current converter 22 extracts a direct current voltage from the processed encoded signal received from the isolating circuit 21. The direct current voltage is used to power operations of the processor 24 and the driver 25.

The detecting circuit 23 includes a zero-crossing detecting circuit for detecting zero voltage points in the encoded signal and for generating a wave signal (see FIG. 10(*f*)) in digital form according to the zero voltage points in the encoded signal. In particular, when the encoded signal has zero amplitude, the detecting circuit 23 causes the wave signal to be at a high potential level. On the other hand, when the encoded signal has non-zero amplitude, the detecting circuit 23 causes the wave signal to be at a low potential level.

The processor 24 detects a level of the wave signal and generates multi-bit recovered data (see FIG. 10(*h*)) according to a second trigger signal (see FIG. 10 (*g*)). The frequency of the second trigger signal is the same as that of the first trigger signal. However, the second trigger signal has a suitable time delay with respect to the first trigger signal in order to increase accuracy of the recovered data. In this embodiment, the second trigger signal is generated using a built-in oscillator. In practice, the second trigger signal may be obtained from the first trigger signal using a built-in clock recovery circuit, or from an external source in other embodiments of the invention.

In this embodiment, when the wave signal is at a high potential level at a rising edge of the second trigger signal, the bit of the recovered data generated by the processor 24 is a 1. On the other hand, when the wave signal is at a low potential level at a rising edge of the second trigger signal, the bit of the recovered data generated by the processor 24 is a 0. While detection is conducted at the rising edge of the second trigger signal in this embodiment, the detection may be conducted at a falling edge of the second trigger signal or when the second trigger signal is at the high potential level in other embodiments of the invention.

The processor 24 includes an inverter 241 for inverting the recovered data to obtain the decoded data (see FIG. 10(*i*)) related to color to be emitted by the LED unit 3.

The driver 25 receives the direct current voltage from the direct current converter 22 and the decoded data from the processor 24. The driver 25 drives the LED unit 3 such that the latter changes the color of light emitted thereby or maintains the color of light emitted thereby according to the decoded data.

It should be noted herein that the encoding device 1 and the lamp of the controlled lighting system of this invention could be sold separately.

In sum, the encoding device 1 for a LED lamp, the lamp, and the controlled lighting system according to the present invention utilize the encoder 14 to generate an encoded signal that combines the AC voltage input 5 and the display data, so that a single transmission line is sufficient to connect the encoding device 1 to an input port of the lamp for illumination control. Moreover, since the encoding device 1 receives the AC voltage input 5 directly, there is no need for an adapter in this invention. Furthermore, this invention simplifies the configuration of the lamp, reduces the required amount of wires, and shortens the time for installing a lighting network.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An encoding device for a light-emitting-diode (LED) lamp, said encoding device being adapted to receive an alternating current (AC) voltage input and display data related to a light-emitting operation, said encoding device comprising:

a rectifier for rectifying the AC voltage input to result in a rectified signal; and an encoder for generating an encoded signal from the rectified signal and the display data, the encoded signal having an amplitude corresponding to a magnitude of the rectified signal, and a waveform corresponding to the display data, the encoded signal having a plurality of consecutive signal regions of equal time durations, each of the signal regions having one of first and second states, the waveform of the signal region having the first state being a positive half-cycle of an AC sinusoidal wave, the waveform of the signal region having the second state being a low potential waveform;

the display data including a plurality of bits, wherein said encoding device further comprises a zero-crossing detecting circuit for detecting zero voltage points in the AC voltage input and for generating a first trigger signal having a plurality of pulses corresponding to the zero voltage points, said encoder processing one of the bits of the display data each time one of the pulses of the first trigger signal is received thereby;

wherein said encoder includes a control circuit for selecting one of the first trigger signal and the low potential waveform for output as a control signal in accordance with the bit of the display data that is being processed, and a switch controlled by the control signal such that the state of the waveform of one of the signal regions of the encoded signal corresponds to the bit of the display data that is being processed.

2. The encoding device as claimed in claim 1, wherein an amplitude of the rectified signal from said rectifier increases with an increase in an amplitude of the AC voltage input, and an amplitude of the signal regions of the encoded signal having the first state increases with an increase in the amplitude of the rectified signal.

3. The encoding device as claimed in claim 1, wherein, when the display data has a value of 1, the waveform of a corresponding one of the signal regions of the encoded signal has the first state, and when the display data has a value of 0, the waveform of a corresponding one of the signal regions of the encoded signal has the second state.

4. The encoding device as claimed in claim 1, wherein the rectified signal from said rectifier has a waveform that includes a plurality of consecutive regions of equal time durations, the waveform in each of the regions of the rectified signal being a positive half-cycle of the AC sinusoidal wave, said encoder selectively outputting the regions of the waveform of the rectified signal to result in the encoded signal.

5. The encoding device as claimed in claim 1, wherein said switch is a silicon-controlled rectifier.

6. The encoding device as claimed in claim 1, further comprising a direct current regulator for regulating the rectified signal to result in a direct current voltage that is provided to said encoder.

7. An encoding device for a light-emitting-diode (LED) lamp, said encoding device being adapted to receive an alternating current (AC) voltage input and display data related to a light-emitting operation, said encoding device comprising:

a rectifier for rectifying the AC voltage input to result in a rectified signal; and an encoder for generating an encoded signal from the rectified signal and the display data, the encoded signal having an amplitude corresponding to a magnitude of the rectified signal, and a waveform corresponding to the display data, the encoded signal having a plurality of consecutive signal regions of equal time durations, each of the signal regions having one of first and second states, the waveform of the signal region having the first state being a positive half-cycle of an AC sinusoidal wave, the waveform of the signal region having the second state being a low potential waveform;

the display data including a plurality of bits, wherein said encoding device further comprises a zero-crossing detecting circuit for detecting zero voltage points in the AC voltage input and for generating a first trigger signal having a plurality of pulses corresponding to the zero voltage points, said encoder processing one of the bits of the display data each time one of the pulses of the first trigger signal is received thereby;

wherein said encoder includes a control circuit for outputting a high potential waveform or a low potential waveform within a time period spanning two corresponding adjacent ones of the pulses of the first trigger signal as a control signal in accordance with the bit of the display data that is being processed, and a switch controlled by the control signal such that the state of the waveform of one of the signal regions of the encoded signal corresponds to the bit of the display data that is being processed.

8. The encoding device as claimed in claim 7, wherein said switch is an enabler.

9. A controlled lighting system adapted to receive an alternating current (AC) voltage input and display data related to a light-emitting operation, said controlled lighting system comprising:

an encoding device including a rectifier for rectifying the AC voltage input to result in a rectified signal, and an encoder for generating an encoded signal from the rectified signal and the display data, the encoded signal having an amplitude corresponding to a magnitude of the rectified signal, and a waveform corresponding to the display data, the encoded signal having a plurality of consecutive signal regions of equal time durations, each of the signal regions having one of first and second states, the waveform of the signal region having the first state being a positive half-cycle of an AC sinusoidal wave, the waveform of the signal region having the second state being a low potential waveform; and a lamp including a light-emitting-diode (LED) unit, and a decoding device including a direct current converter for extracting a direct current voltage from the encoded signal, a detecting circuit for extracting a wave signal in digital form from the encoded signal, a processor for generating decoded data related to a light-emitting operation of said LED unit in accordance with the wave signal extracted by said detecting circuit, and a driver for driving said LED unit according to the direct current voltage from said direct current converter and the decoded data from said processor;

the display data including a plurality of bits, wherein said encoding device further includes a zero-crossing detecting circuit for detecting zero voltage points in the AC voltage input and for generating a first trigger signal having a plurality of pulses corresponding to the zero voltage points, said encoder processing one of the bits of the display data each time one of the pulses of the first trigger signal is received thereby;

wherein said encoder includes a control circuit for selecting one of the first trigger signal and the low potential waveform for output as a control signal in accordance with the bit of the display data that is being processed, and a switch controlled by the control signal such that the state of the waveform of one of the signal regions of the encoded signal corresponds to the bit of the display data that is being processed.

10. The controlled lighting system as claimed in claim 9, wherein an amplitude of the rectified signal from said rectifier increases with an increase in an amplitude of the AC voltage input, and an amplitude of the signal regions of the encoded signal having the first state increases with an increase in the amplitude of the rectified signal.

11. The controlled lighting system as claimed in claim 9, wherein, when the display data has a value of 1, the waveform of a corresponding one of the signal regions of the encoded signal has the first state, and when the display data has a value of 0, the waveform of a corresponding one of the signal regions of the encoded signal has the second state.

12. The controlled lighting system as claimed in claim 9, wherein the rectified signal from said rectifier has a waveform that includes a plurality of consecutive regions of equal time durations, the waveform in each of the regions of the rectified signal being a positive half-cycle of the AC sinusoidal wave, said encoder selectively outputting the regions of the waveform of the rectified signal to result in the encoded signal.

13. The controlled lighting system as claimed in claim 9, wherein said switch is a silicon-controlled rectifier.

14. The controlled lighting system as claimed in claim 9, wherein said encoding device further includes a direct current regulator for regulating the rectified signal to result in a direct current voltage that is provided to said encoder.

15. The controlled lighting system as claimed in claim 9, wherein the decoded data from said processor is related to color to be emitted by said LED unit.

16. The controlled lighting system as claimed in claim 9, wherein said detecting circuit includes a zero-crossing detecting circuit for detecting zero voltage points in the encoded signal and for generating the wave signal according to the zero voltage points.

17. The controlled lighting system as claimed in claim 9, wherein said processor detects a level of the wave signal and generates recovered data according to a second trigger signal, said processor including an inverter for inverting the recovered data to obtain the decoded data.

18. The controlled lighting system as claimed in claim 9, wherein said decoding device further includes an isolating circuit for isolating noise from the encoded signal prior to receipt of the encoded signal by said direct current converter.

19. A controlled lighting system adapted to receive an alternating current (AC) voltage input and display data related to a light-emitting operation, said controlled lighting system comprising:

an encoding device including a rectifier for rectifying the AC voltage input to result in a rectified signal, and an encoder for generating an encoded signal from the rectified signal and the display data, the encoded signal having an amplitude corresponding to a magnitude of the rectified signal, and a waveform corresponding to the display data, the encoded signal having a plurality of consecutive signal regions of equal time durations, each of the signal regions having one of first and second states, the waveform of the signal region having the first state being a positive half-cycle of an AC sinusoidal wave, the waveform of the signal region having the second state being a low potential waveform; and a lamp including a light-emitting-diode (LED) unit, and a decoding device including a direct current converter for extracting a direct current voltage from the encoded signal, a detecting circuit for extracting a wave signal in digital form from the encoded signal, a processor for generating decoded data related to a light-emitting operation of said LED unit in accordance with the wave signal extracted by said detecting circuit, and a driver for driving said LED unit according to the direct current voltage from said direct current converter and the decoded data from said processor;

the display data including a plurality of bits, wherein said encoding device further includes a zero-crossing detecting circuit for detecting zero voltage points in the AC voltage input and for generating a first trigger signal having a plurality of pulses corresponding to the zero voltage points, said encoder processing one of the bits of the display data each time one of the pulses of the first trigger signal is received thereby;

wherein said encoder includes a control circuit for outputting a high potential waveform or a low potential waveform within a time period spanning two corresponding adjacent ones of the pulses of the first trigger signal as a control signal in accordance with the bit of the display data that is being processed, and a switch controlled by the control signal such that the state of the waveform of one of the signal regions of the encoded signal corresponds to the bit of the display data that is being processed.

20. The controlled lighting system as claimed in claim 19, wherein said switch is an enabler.

* * * * *